United States Patent [19]

Fletcher

[11] 4,450,653

[45] May 29, 1984

[54] KNIFE SHARPENER

[75] Inventor: J. Lawrence Fletcher, Santa Ana, Calif.

[73] Assignee: Fletcher Engineering, Inc., Westminster, Calif.

[21] Appl. No.: 285,491

[22] Filed: Jul. 21, 1981

[51] Int. Cl.[3] ..... B24D 15/08

[52] U.S. Cl. ..... 51/211 R; 248/171; 248/528; 76/82

[58] Field of Search ..... 51/211 R, 211 H, 212, 51/213, 214, 204, 205 R, 205 WG, 246, 181 R, 354, 149, 150, 156, 285; 76/84, 86, 82.2, 82, 81.3; 248/171, 166, 528, 432, 516

[56] References Cited

U.S. PATENT DOCUMENTS

| | | | |
|---|---|---|---|
| 5,649 | 0/1828 | Westby | 76/86 |
| 462,001 | 10/1891 | Foster . | |
| 1,024,126 | 4/1912 | Fletcher | 51/205 R |
| 1,429,984 | 9/1922 | Vollmer . | |
| 1,909,743 | 5/1933 | Blankner . | |
| 2,698,726 | 1/1955 | Howe | 248/528 |
| 2,746,700 | 5/1956 | Barbera | 248/516 X |
| 3,097,457 | 7/1963 | Seligman | 51/205 R |
| 3,894,362 | 7/1975 | Graves | 51/211 |
| 3,942,394 | 3/1976 | Juranitch | 76/84 |
| 4,231,194 | 11/1980 | Glesser | 51/211 |
| 4,259,815 | 4/1981 | Kuban | 76/86 X |

FOREIGN PATENT DOCUMENTS

| | | | |
|---|---|---|---|
| 40014 | 7/1924 | Norway | 51/392 |

*Primary Examiner*—Frederick R. Schmidt
*Assistant Examiner*—Robert A. Rose
*Attorney, Agent, or Firm*—Knobbe, Martens, Olson & Bear

[57] ABSTRACT

A knife sharpener, comprising a sharpening rod mounted in a base, includes a first expandable position for storage as a compact unit.

Wing members project laterally from a central member to provide stability during use, but are retractable into a cutout in the central member for compact storage. The wing members are drivingly connected to a support block for mounting the rod, so that when the wing members are positioned for use, the rod is rotated to an upright position. However, when the wing members are retracted, the rod rotates to a horizontal position, within a recess in the central member, for storage.

The knife sharpener includes a rod mounting assembly comprising a sleeve, having a diameter larger than the rod, to permit the rod to be inclined, in any direction, at a predetermined angle relative to the sleeve. This predetermined angle is adjustable by rotating a plug, threadedly mounted in the sleeve.

27 Claims, 6 Drawing Figures

KNIFE SHARPENER

BACKGROUND OF THE INVENTION

The present invention relates to knife sharpeners, and particularly to knife sharpeners utilizing abrasive sharpening rods. In addition to sharpening knives, the present invention may be used for sharpening other cutting implements such as scissors and tools.

Abrasive rod knife sharpeners typically include a holder or stand for rigidly mounting the rods. Usually the stand is adapted to mount the rods so that they are inclined from the vertical, at a fixed, predetermined angle. This permits the user to sharpen the cutting edge to a fixed bevel, corresponding to the fixed angle of inclination of such rods. Such bevel is usually achieved by pressing the blade against the sharpening rod, with the face of the blade vertical, and drawing it down across the sharpening rod in a single stroke. Alternatively, the blade may be pressed against the rod and sharpened by rubbing in circles. With regard to serrated knives, each serration is typically individually sharpened by drawing the knife downward, with only one such individual serration in contact with the rod on any given sharpening stroke.

Commonly, two rods, inclined at equal angles, but in opposite directions from the vertical, are provided to permit both sides of the blade to be sharpened without rotating the rod holder. The rods may be oriented in the shape of a "V", as shown in U.S. Pat. Nos. 4,231,194 and 3,894,362, issued to Glesser and Graves, respectively, or they may be in crossed relationship, as disclosed in U.S. Pat. Nos. 1,429,984 and 462,001, issued to Vollmer and Foster, respectively. However, in either case, a minimum of two sharpening rods are required, thus increasing the overall cost of the sharpener. Further, those sharpeners utilizing rods in crossed relationship typically wear out more rapidly, since the blade tends to contact the same portion of the rods on each sharpening stroke. On the other hand, those sharpeners utilizing rods oriented in the shape of a "V" require that the user adjust his position slightly each time he moves the knife blade from one rod to the other, thus resulting in some loss of accuracy, awkwardness and user discomfort.

Another disadvantage of prior art knife sharpeners is that they are usually not adjustable, and thus, sharpen to only a single bevel. Although this problem was recognized in U.S. Pat. No. 1,909,743, issued to Blankner, the Blankner device comprises an extremely complex mechanism. Further, like the above-discussed patents, the Blankner device requires a minimum of two sharpening rods.

A further disadvantage to prior art knife sharpeners is that they are often bulky and are not adapted for compact storage.

SUMMARY OF THE INVENTION

The present invention solves these and other problems of the prior art by providing a knife sharpener which utilizes only a single sharpening rod, and is adjustable, between three degrees and thirty-five degrees from the vertical, to provide corresponding bevels on the knife blade. This is accomplished by mounting one end of the sharpening rod in a vertically oriented sleeve. A plug, threadedly mounted within the sleeve, at the lower end thereof, is included to support the bottom of the rod to prevent it from passing through the sleeve.

The sleeve has interior dimensions slightly larger than the corresponding exterior dimensions of the rod to permit the rod, when inserted therein, to incline relative to the vertical. However, by rotating the threaded plug, the depth of insertion of the rod may be varied to adjust the angle of inclination. Further, by properly sizing the radial tolerance between the sleeve and the rod, such angle of inclination may be varied between three and thirty-five degrees, simply by rotating the threaded plug.

The preferable method of use of the knife sharpener of the present invention is as follows. On the first sharpening stroke, the user presses one side of the knife blade, at the point nearest the handle, against the sharpening rod and draws it down and thereacross. On the second stroke, the other side of the knife blade is pressed against the sharpening rod and drawn downwardly thereacross in a similar manner. This process is repeated, with opposite sides of the blade sharpened on alternate strokes, until the desired bevel and cutting edge is attained. Of course, to insure a proper bevel, the face of the blade should always be maintained in a vertical orientation during the sharpening strokes.

It is significant that the sharpening rod may be inclined in any direction, radially outward from the central longitudinal axis of the vertical sleeve. Further, for a given position of the threaded plug, the angle of inclination will be the same, regardless of the direction of such inclination. Thus, in contrast to prior art sharpeners, the present invention permits the user to draw the knife blade across the sharpening rod in any direction he chooses, thereby alleviating awkwardness and discomfort associated with some prior art knife sharpeners. Further, the present invention permits the full length of the rod to be utilized during sharpening, and thus, the rod tends to wear evenly along its longitudinal dimension. Moreover, if uneven wear occurs along one side of the rod, the rod may be periodically rotated slightly within the sleeve to equalize such wear. Also, the action of the sharpening strokes may tend to provide such slight rotation automatically, as this rotational action may be controlled by the snugness of fit of an elastomeric grommet, connected between the upper portion of the sleeve and the adjacent portion of the sharpening rod. This grommet additionally functions to resiliently bias the sharpening rod to a vertical position, more or less coincident with the longitudinal axis of the sleeve. Thus, after each sharpening stroke, the rubber grommet automatically returns the sharpening rod to such vertical position. Although this grommet is not essential to the operation of the present invention, it advantageously places the rod in a "ready" position after each sharpening stroke for ease of manipulation of the knife blade in preparation for the next sharpening stroke.

This invention, therefore, provides an extremely simple, convenient, easy to manufacture, and relatively inexpensive knife sharpener that is adjustable for a wide range of bevels.

As indicated above, it is desirable for knife sharpeners to be foldable or collapsible for compact storage, while maintaining sufficient stability during use for effective sharpening. Accordingly, the present invention includes a stand or base which rotatably mounts the sleeve and sharpening rod, and has a recess, sized to receive such sleeve and sharpening rod. The stand includes an elongated central member, and a pair of wing members, rotatably mounted thereto, and sized to fit within a cutout in the central member, so that they may be rotated from a first position, compactly stored within such cutout, to a second position, perpendicular to the central member, to provide stability during use. At least one of the wing members is connected by gears to drive the sharpening rod from its stored position in the recess to its vertical upright position when the wing members are rotated from their first position to their second position. These gears also return the sharpening rod to its stored position when the wing members are rotated from their second position to their first position.

When the sharpener is in use, the user typically holds the base member with his hand to prevent movement thereof. Since this places one of the user's hands in close proximity to the blade of the knife being sharpened, the user may be exposed to injury. Accordingly, the present invention advantageously includes a guard member for shielding the user's hand. This guard member is pivotally attached to the base and is mechanically connected to be driven upward to an angle of about 30 to 45 degrees when the sharpening rod is driven to its upright vertical position, as described above.

DESCRIPTION OF THE DRAWINGS

These and other advantages of the present invention are best understood through reference to the drawings, in which:

FIG. 3 further shows the resilient grommet for biasing the rod towards the vertical, and illustrates the action of the sharpening rod during sharpening;

DETAILED DESCRIPTION OF THE PREFERRED EMBODIMENT

Figure 1:
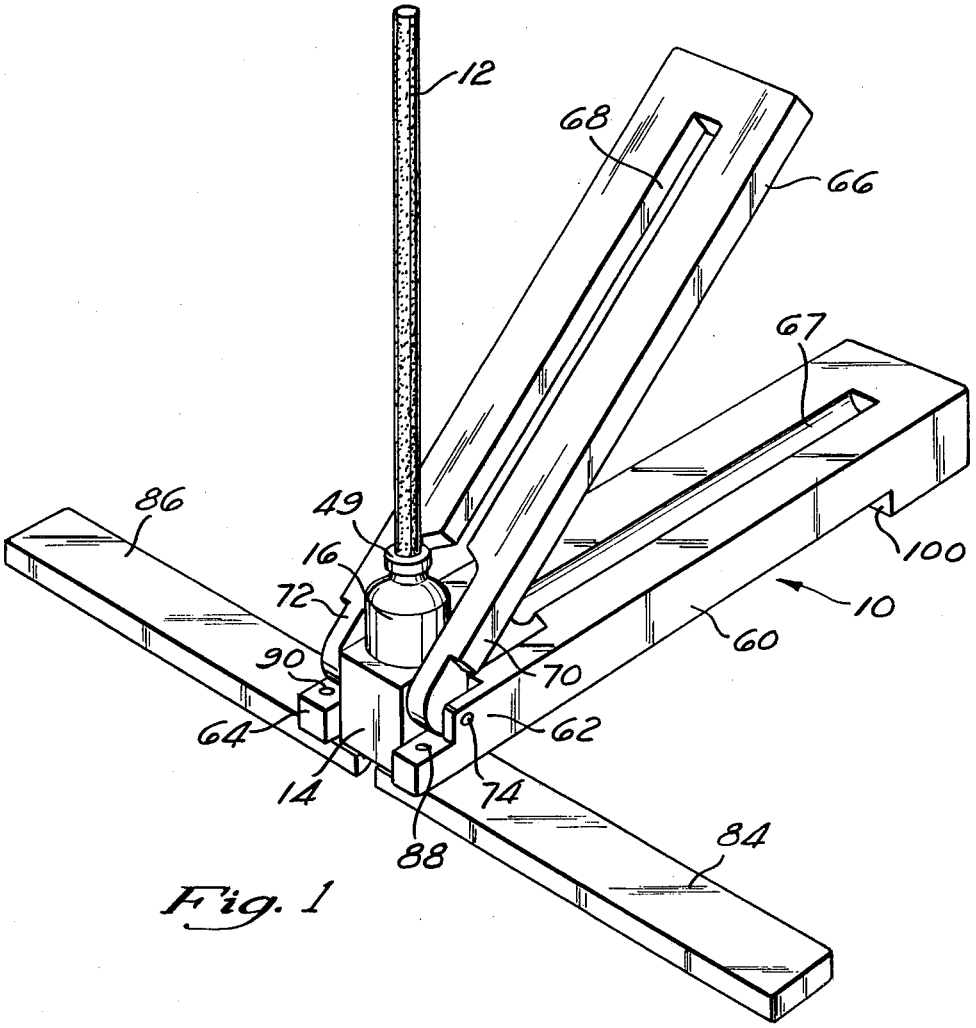
FIG. 1 is a perspective view of the knife sharpener of the present invention, positioned for use, showing the wing members oriented perpendicular to the central member, the guard member inclined angularly relative to the central member, and the sharpening rod in an upright, vertical position.

Referring to FIG. 1, the knife sharpener of the present invention includes a stand or base 10 which mounts a single sharpening rod 12 in a vertical upright position. This base 10 will be described in more detail subsequently, however, it should presently be understood that the base 10 comprises a support block 14 having a mounting assembly 16 for retaining the sharpening rod 12.

Figure 2:
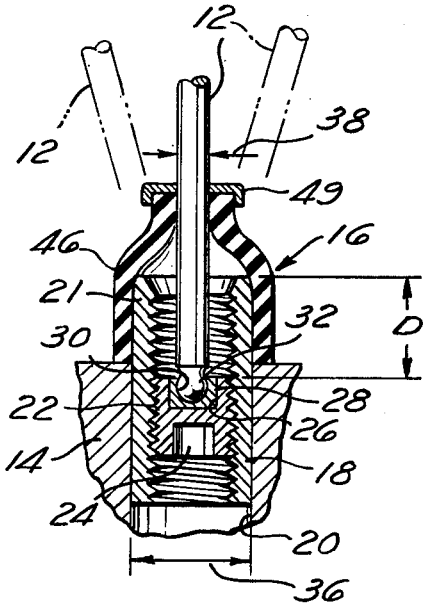
FIG. 2 is an enlarged cross-sectional view of the rod mounting assembly showing the sleeve mounted in the support block, the rod angle adjusting plug threadedly mounted in the sleeve, and the rod pivotally mounted, by a ball joint, in the adjusting plug.

As shown in FIG. 2, the mounting assembly 16 comprises a tube or sleeve 18, rigidly mounted in a vertical bore 20 in the support block 14. In the embodiment shown, a portion 21 of the sleeve 18 projects above the upper surface of the support block 14. The interior of the sleeve 18 is threaded to receive a correspondingly threaded plug 22. A slot 24, formed in the bottom of the plug 22, is sized to receive the blade of a screw driver, allen wrench, or the like, to permit the plug 22 to be rotatably driven along the threaded bore of the sleeve 18. Formed at the top of the plug 22, in the center thereof, is a cylindrical recess 26 which receives a bushing 28, for example of nylon, having a socket 30 therein. This socket 30 is sized to receive a ball 32, formed on the bottom end of the sharpening rod 12. The ball 32 and socket 30 cooperate to form a ball joint, thus permitting the sharpening rod 12 to incline in any direction, radially outward from the central longitudinal axis of the vertical sleeve 18.

Such inclination of the sharpening rod 12 is accommodated by making the inside diameter of the sleeve 18, shown by the reference numeral 36, larger than the outside diameter of the rod 12, shown by the reference numeral 38. The difference between these dimensions (i.e., dimension 36 minus dimension 38) will be referred to herein as the "dimensional tolerance". Thus, for a sleeve 18 having a given longitudinal dimension and a given position of the plug 22, the dimensional tolerance determines the maximum angle of inclination of the rod 12. That is, the larger the dimensional tolerance, the greater the angle of inclination, and the smaller the dimensional tolerance, the lesser the angle of inclination. In the preferred embodiment, the dimensional tolerance is constant for all positions of the plug 22, the angle of inclination being variable by adjusting the position of the plug 22 along the longitudinal dimension of the sleeve 18. When the distance between the top of the sleeve 18 and the top of the plug 22, represented by the dimension D, increases, the inclination of the rod 12 will decrease. Conversely, when the dimension D decreases, the angle of inclination will increase. Thus, the angle of inclination of the rod 12 is inversely proportional to the dimension D, and may be varied simply by rotating the threaded plug 22 to adjust its position relative to the longitudinal axis of the sleeve 18.

The size of the sleeve 18, rod 12, and dimensional tolerance therebetween, may be determined empirically to provide the desired inclination angle range.

Figure 3:
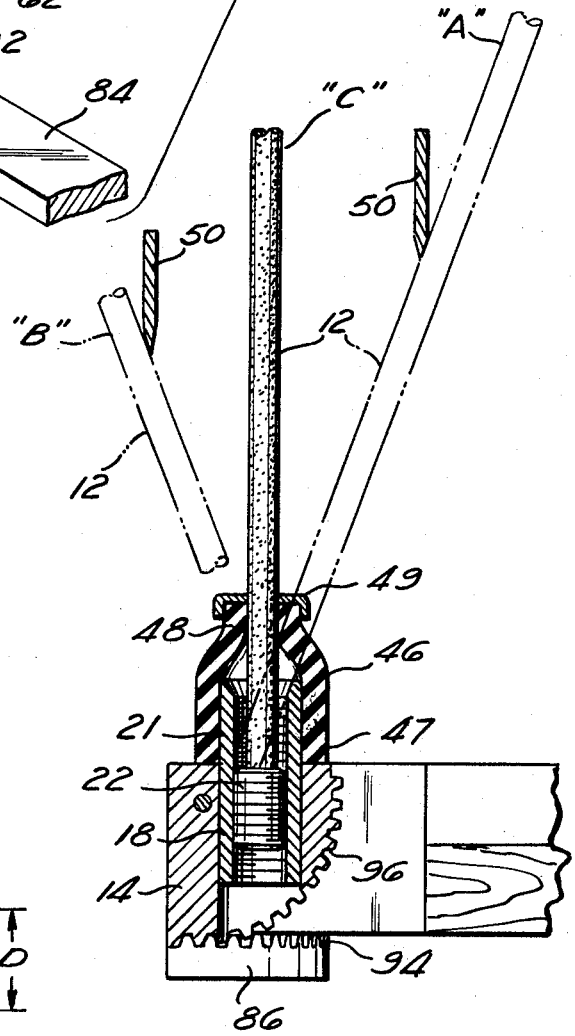
FIG. 3 is an enlarged cross-sectional view of the rod mounting assembly, similar to that of FIG. 1, except that the sharpening rod is bearing directly against the top of the adjusting plug, without attachment thereto by the ball joint.

It will be understood that the ball joint connection, formed by the ball 32 and socket 30, described above in reference to FIG. 2, is not essential to the operation of the present invention. Rather, as shown in FIG. 3, the bottom end of the rod 12 may rest against, and be supported by, the top surface of the plug 22, without attachment thereto. If desired, such bottom end of the rod 12 and top surface of the plug 22 may be correspondingly rounded so that they are convex and concave, respectively.

In any case, the present invention preferably includes a grommet 46, formed of a resilient material, such as rubber, as shown in FIG. 3. The grommet 46 is a tubular member, sized at its lower end 47 to fit snugly around the exterior of the portion 21 of the sleeve 18 that projects above the support block 14, and sized at its upper end 48 to fit snugly around the rod 12, at a point sufficiently above the top of the sleeve 18 to permit lateral movement of the top portion 48 of the grommet relative to the bottom portion 47 throughout the maximum angle of inclination of the rod 12. It may be desirable to more securely fasten the grommet 46 to the sleeve 18 by providing an integrally formed snap ring (not shown) on the interior of the grommet 46 which snaps into a corresponding annular groove (not shown) on the exterior of the sleeve 18. The grommet 46 is sufficiently resilient to continuously bias the sharpening rod 12 from an inclined position towards the vertical, which, as will be seen, is particularly advantageous during use of the knife sharpener. In addition, an annular metal cap or collar 49 is disposed on the top of the grommet 46 to protect this grommet 46 from being inadvertently cut by the knife during sharpening.

The preferable method of use of the knife sharpener of the present invention will now be described. On the first sharpening stroke, the user presses one side of a knife blade 50, at the point nearest the handle, against the sharpening rod 12 and draws it downwardly and thereacross. Such pressure of the knife blade 50 against the sharpening rod 12 will incline the sharpening rod, as shown in phantom lines in FIG. 3, to the angle position labeled "A", determined by the position of the plug 22, as shown in FIG. 3. By maintaining the face of the blade in a vertical orientation during the sharpening stroke, the rod 12 will tend to grind the blade 50 to a bevel equal to the angle of inclination. After the first stroke is completed, the biasing action of the grommet 46 returns the sharpening rod 12 to a vertical position, labeled position "C", as shown in solid lines. On the second sharpening stroke, the other side of the knife blade 50 is pressed against the sharpening rod 12 to incline the rod 12 to the position labeled "B" in FIG. 3. Again, by maintaining the face of the blade 50 in a vertical orientation, and drawing it down across the rod 12, the side of the blade 50 in contact with the rod 12 will tend to be ground to a bevel corresponding to the angle of inclination of the rod 12. This process is repeated, with opposite sides of the blade 50 sharpened on alternate strokes, until the desired bevel and cutting edge is attained. Both sides of the knife blade 50 will be ground to the same bevel, since the rod inclination angle is always constant for a given position of the plug 22. It will be understood that, rather than drawing the blade 50 downwardly across the rod 12 in a single stroke, as described above, the blade 50 may be alternatively sharpened by rubbing it, in a circular motion, against the rod 12. Further, it will be recognized that the knife sharpener of the present invention may be used for serrated knives by sharpening each serration individually (i.e., by drawing the knife downwardly, but not across, the rod 12, so that only one such individual serration is in contact with the rod 12 on any given sharpening stroke).

From the above description of the sharpening process, it can be seen that the grommet 46, while not essential to the operation of the present invention, advantageously places the rod in a "ready" position after each sharpening stroke for ease of manipulation of the knife blade 50 in preparation for the next sharpening stroke. Moreover, since the sharpening rod 12 may be inclined, at a constant angle in any direction, the user may draw the knife blade 50 across the sharpening rod 12 in any direction he chooses, thereby alleviating the awkwardness and discomfort associated with prior art knife sharpeners.

Since the sharpening rod 12 is rotatable with respect to the grommet 46 (and ball joint 30,32 in FIG. 2), the user may periodically turn the rod 12 slightly with respect to the sleeve 18 to prevent the rod from wearing unevenly. Further, depending on the frictional engagement between the rod 12 and the grommet 46, sleeve 18, and plug 22, the action of the sharpening strokes may tend to provide this slight turning action, thereby automatically equalizing rod wear.

Although the foregoing discussion of the present invention indicates that, in the preferred embodiment, the rod 12 is oriented in a generally upright, vertical position, with the face of the blade 50 in a vertical position during sharpening, it will be understood that various other orientations of the rod 12 and blade 50 may be used alternatively without departing from the inventive concepts, described herein. For example, the rod 12 may be oriented generally horizontally, with the face of the blade 50 in a horizontal position during sharpening. Moreover, depending on the particular instrument involved, it may be desirable to orient the blade 50 and rod 12 so that, during sharpening, they are generally perpendicular to each other, such as is typically the case with scissor sharpening. However, regardless of the particular orientation of the rod 12 and blade 50, the dimensional tolerance between the sleeve 18 and rod 12 permits the rod 12 to be inclined in any direction from such orientation, at the same angle of inclination for all such directions.

Figure 5:
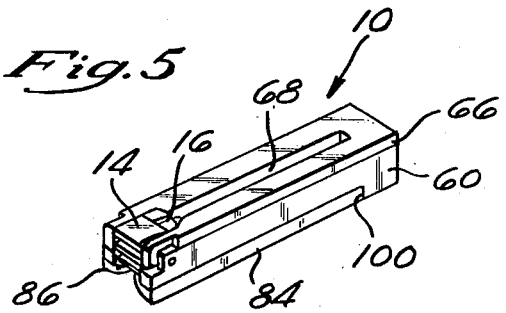
FIG. 5 is a perspective view showing the knife sharpener folded into a compact unit for storage, and particularly showing the wing members stored within the central member cutout, and the sharpening rod stored within the guard member cutout and central member recess.
Figure 4:
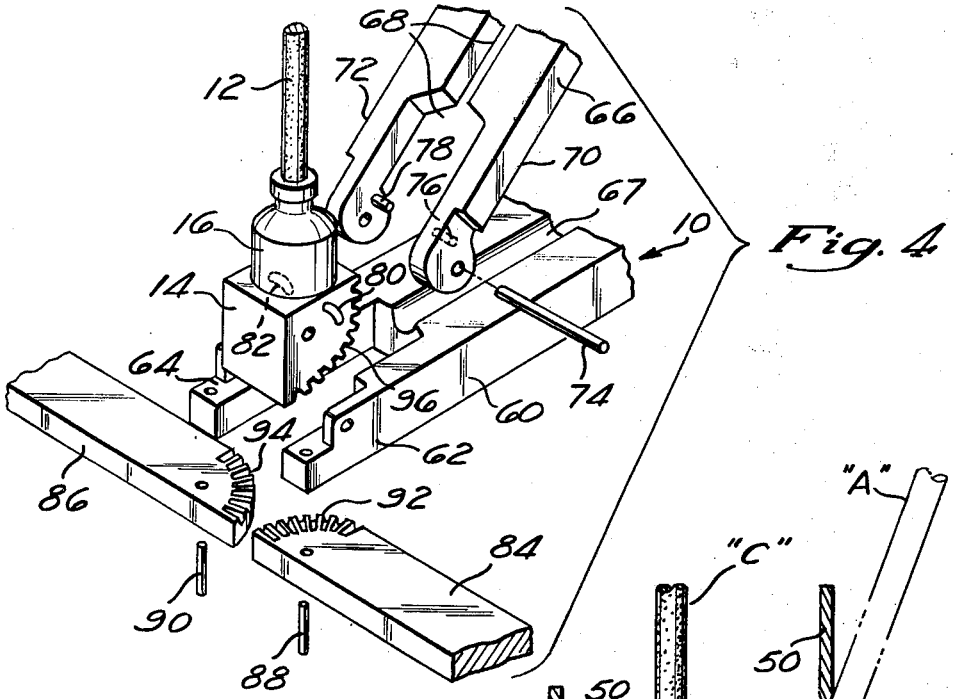
FIG. 4 is an exploded partial perspective view of the knife sharpener showing the gears for providing driving engagement between the support block and wing members, and showing the pins and slots for driving the guard member in response to rotation of the support block.

Referring to FIGS. 1, 4, and 5, the base 10 is adapted to permit the knife sharpener of the present invention to be foldable or collapsable for compact storage. As best seen in FIG. 4, the base 10 comprises an elongated central member 60 formed as a rectangular block, and having a pair of forks 62,64 projecting from one end thereof, for rotatably mounting the support block 14 therebetween. The central member 60 includes an elongated recess 67, sized to receive the mounting assembly 16 and rod 12 for storage thereof. An elongated guard member 66, approximately equal in length to the central member 60, may also be rotatably mounted between the forks 62,64. This guard member 66 has a cutout 68 which forms a pair of forks 70,72 in the guard member 66, the cutout 68 being elongated to a contour which permits passage of the support block 14, mounting assembly 16, and rod 12 therethrough. The forks 70,72 of the guard member 66, forks 62,64 of the central member 60, and the support block 14 are all rotatably connected by a common horizontal shaft 74, with the support block 14 between the forks 70,72, and with the forks 70,72 between the support block 14 and the forks 62,64, respectively. In addition, each of the forks 70,72 have respective pins 76,78 which project towards each other along a common axis parallel to the axis of the shaft 74. These pins 76,78 are received by respective arcuate slots 80,82 formed on opposite sides of the support block 14.

The base 10 also includes a pair of elongated wing members 84,86 rotatably mounted at one end, by respective vertical pins 88,90, to the bottom of the forks 62,64, respectively. The wing members 84,86 are sized to fit within a cutout 100 (FIG. 1). This cutout 100, formed in the bottom of the central member 60, is sized to permit the wing members 84,86 to be flush with the sides of the central member 60 for compact storage. However, the wing members 84,86 may be rotated laterally outward, perpendicular to the member 60, to provide lateral stability for the base 10 during sharpening.

Each of the wing members 84,86 include respective gear teeth 92,94 which mesh with corresponding gear teeth 96 on the support block 14. The gear teeth 92,94,96 are formed and aligned so that, when the wing members 84,86 are rotated from a first position, projecting perpendicularly in opposite directions from the central member 60, to a second position, within the cutout 100 (FIG. 1) formed in the bottom of the central member 60, the support block 14 is responsively driven to rotate the rod 12 from a vertical first position, projecting perpendicular to the central member 60, to a horizontal second position, projecting longitudinally along the central member 60 and stored within the recess 67, as best seen by comparing FIG. 1 with FIG. 5. Conversely, when the wing members 84,86 are rotated from their second position to their first position, the interaction of the gears 92,94 with the gear 96 rotates the support block 14 so that the rod 12 automatically returns from its horizontal, stored position, as shown in FIG. 5, to its upright position for use, as shown in FIG. 1. Thus, the base 10 permits the sharpener to be foldable into a compact unit, with the rod 12 and mounting assembly 16 stored in the recess 67 and the wing members 84,86 stored within the cutout 100.

It will be understood that, although the interaction of the gears 92,94,96 was described above as driving the block 14 and rod 12 to rotate in response to rotation of the wing members 84,86, such gear interaction will also drive the wing members 84,86 to rotate in response to rotation of the rod 12 and block 14. Thus, the gears 92,94,96 require correspondence between the wing member first position and the rod first position, and between the wing member second position and rod second position, regardless of whether the rod 12 is being driven by the wing members 84,86 or whether the wing members 84,86 are being driven by the rod 12.

Figure 6:
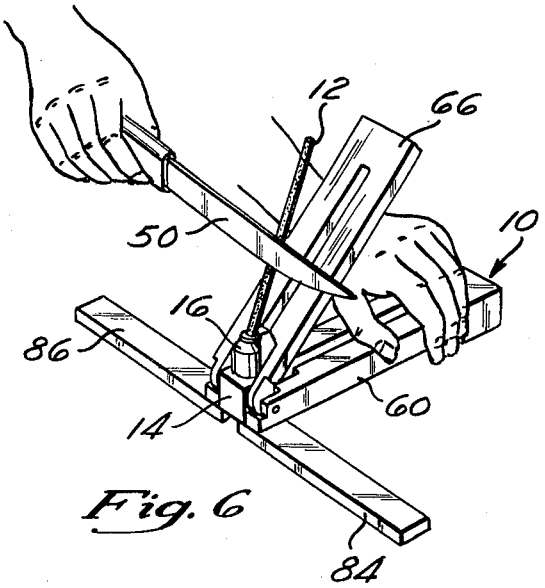
FIG. 6 is a perspective view of the knife sharpener showing the guard member angularly inclined to provide protection for the user's hand during sharpening.

It will be recalled that the guard member 66 includes a cutout 68, contoured to permit passage of the mounting assembly 16 and rod 12 therethrough. Consequently, this guard member 66 will not interfere with the above-described movement of the rod 12 between its horizontal and vertical positions. It will further be recalled that the guard member 66 has pins 76,78, which are received by the respective arcuate slots 80,82 in the support block 14. These slots 80,82 are positioned so that, when the block 14 and rod 12 are in the horizontal first position for storage, the guard member 66 rests flush against the top of the central portion 60, with the pins 76,78 adjacent to, or engaging, the upper end of the slots 80,82, respectively. This places the guard 66 in a first position for storage. However, the slots 80,82 are sized so that, when the support block 14 rotates to move the rod 12 upward by a predetermined acute angle (e.g., approximately 45 to 60 degrees), the pins 70,72 are drivingly engaged by the lower end of the slots 80,82, respectively. Thus, as the support block 14 continues to rotate to bring the rod 12 to its upright second position, such continued rotation will raise the guard member 66 to the complement of said predetermined angle (e.g., approximately 30 to 45 degrees with respect to the central member 60). This places the guard member 66 in a second position sufficiently above the central member 60 to permit the user to grasp such central member 60, as shown in FIG. 6, with the guard member 66 interposed between the sharpening rod 12 and the user's hand. However, such position of the guard member 66 also provides sufficient clearance relative to the rod 12 to prevent the guard 66 from interfering with the action of the knife blade 50 (FIG. 3) or rod 12 during sharpening.

Thus, when the guard member 66 is in its second position, it provides protection against the accidental cutting of the user's hand, without interfering with the use of the knife sharpener, as illustrated in FIG. 6. However, when the guard member 66 is in its first position, it projects longitudinally along the central member 60 for compact storage. Further, the interaction of the pins 76,78, and slots 80,82, respectively, provides correspondence between the support block 14 first position and the guard 66 first position and between the support block 14 second position and the guard member 66 second position.

What is claimed is:

1. A knife sharpener, comprising:

a sharpening rod for sharpening the cutting edge of a knife blade;

means for mounting said rod for pivotal movement, means for limiting said pivotal movement to a selected range of pivotal movement, a different portion of the surface of said rod being in an operable position for use as a knife sharpener at each of the limits of said range of pivotal movement, whereby a user may first sharpen one side of a knife on one portion of the surface of said rod at a first limit of said range and then sharpen the other side of said knife on a different portion of the surface of said rod at a second limit of said range; and said mounting means including resilient means for urging said rod toward the center of said range of pivotal movement.

2. A knife sharpener, as defined by claim 1, wherein said rod is generally vertical with respect to said mounting means when positioned at the center of said range of pivotal movement.

3. A knife sharpener, as defined by claim 1, wherein said mounting means comprises means for adjusting said range of pivotal movement to adjust said limits.

4. A knife sharpener, as defined by claim 1, wherein the angle from the center of said range of pivotal movement to each of the limits of said range is the same and is adjustable between 3 degrees and 35 degrees.

5. A knife sharpener, as defined by claim 1, wherein said resilient means comprises a grommet formed from elastomeric material.

6. A knife sharpener, as defined by claim 5, wherein said resilient means additionally comprises means for shielding said grommet to protect it from the cutting edge of said knife.

7. A knife sharpener, as defined by claim 6, wherein said shield means comprises a metal collar.

8. A knife sharpener, as defined by claim 1, wherein said mounting means comprises:

a tube sized for insertion of one end of said sharpening rod therein.

9. A knife sharpener, as defined by claim 3, wherein said mounting means comprises a tube, sized for insertion of one end of said sharpening rod therein, and wherein said adjusting means comprises a plug, mounted in said tube, said plug preventing said rod from being inserted into said tube past a predetermined depth, the position of said plug relative to said tube adjustable to vary said predetermined depth.

10. A knife sharpener, comprising:

a base;

a sharpening rod for sharpening the cutting edge of a knife blade by drawing said blade against said rod;

a sleeve, mounted on said base, for receiving one end of said rod, said sleeve having interior dimensions larger than the corresponding dimensions of one end of said rod by a predetermined amount to permit said rod to be inclined at an angle relative to said sleeve when inserted therein; and means, adjustably mounted at the lower end of said sleeve, for supporting said one end of said rod, said supporting means preventing said rod from being inserted in said sleeve past a predetermined depth, said predetermined depth and said predetermined dimensional amount defining an angle of inclination between said sleeve and said rod, said angle of inclination variable by adjusting said supporting means to vary said predetermined depth.

11. A knife sharpener, as defined by claim 10, additionally comprising means for biasing said rod from said angle of inclination towards the longitudinal axis of said sleeve.

12. A knife sharpener, as defined by claim 10, wherein said supporting means comprises a plug having a socket therein for receiving a ball on said one end of said rod, said ball and said socket forming a ball joint.

13. A knife sharpener, as defined by claim 10, wherein said sleeve is rotatable, between a first position and a second position, said first position of said sleeve orienting said rod for use and said second position orienting said rod for storage.

14. A knife sharpener, as defined by claim 13, wherein said sleeve is generally perpendicular to said base in said first position and generally parallel to said base in said second position.

15. A knife sharpener, as defined by claim 13, wherein said base comprises means for driving said sleeve to rotate between said first position and said second position.

16. A knife sharpener, as defined by claim 15, wherein said base comprises a central member and said driving means comprises:

a support block for mounting said sleeve, said support block rotatably mounted on said central member and comprising a first gear; and a wing member, rotatably mounted, at one end, on said central member, said wing member comprising a second gear meshing with said first gear, said gears interacting to drive said sleeve between said first and second positions in response to rotation of said wing member.

17. A knife sharpener, as defined by claim 16, additionally comprising:

a guard member, rotatably mounted on said central member for shielding the user's hand from said blade during sharpening, said guard operably connected to said support block to rotate said guard member from a first position parallel to said central member to a second position angularly inclined thereto.

18. A knife sharpener, comprising:

a sharpening rod for sharpening the cutting edge of a knife blade by drawing said knife blade thereacross;

a base, for mounting said sharpening rod, comprising:

an elongated central member;

means, mounted on said central member, for stabilizing said knife sharpener during sharpening, said stabilizing means being movable between a first and a second position, in said first position said stabilizing means projects laterally from said central member to provide lateral support for said base during sharpening, and in said second position said stabilizing means lies longitudinally along said central member for compact storage; and means for mounting said sharpening rod on said base, said mounting means having a first position for orienting said sharpening rod outwardly from said base to position said sharpening rod for use, and a second position for orienting said sharpening rod longitudinally along said base to position said sharpening rod for compact storage;

means for operably connecting said stabilizing means to said mounting means, said operable connecting means (i) providing driving engagement between said stabilizing means and said mounting means, and (ii) requiring correspondence between said stabilizing means first position and said mounting means first position, and between said stabilizing means second position and said mounting means second position.

19. A knife sharpener, as defined by claim 18, wherein said connecting means comprises a first gear on said stabilizing means, and a second gear on said mounting means, meshing with said first gear.

20. A knife sharpener, as defined by claim 18, additionally comprising:

a guard member, mounted on said base for shielding the user's hand during sharpening, said guard member having a first position, inclined at an acute angle relative to said base to permit said user to grasp said elongated central member with said guard member interposed between the user's hand and said rod, and having a second position oriented longitudinally along said base for compact storage of said guard member.

21. A knife sharpener, as defined by claim 20, wherein said guard member includes an opening sized to permit said sharpening rod to pass therethrough.

22. A knife sharpener, as defined by claim 21, wherein said base additionally comprises second means for operably connecting said guard member to said mounting means, said second connecting means (i) providing driving engagement between said guard member and said mounting means and (ii) providing correspondence between said mounting means first position and said guard member first position, and between said mounting means second position and said guard member second position.

23. A knife sharpener, as defined by claim 1, further comprising a shield pivotally connected to said mounting means for protecting the hands of a user.

24. A knife sharpener, comprising:

a sharpening rod for sharpening the cutting edge of a knife blade by drawing said knife blade against said rod; and means for mounting said sharpening rod in a predetermined orientation, said mounting means permitting limited inclination of said rod in at least two different directions from said predetermined orientation, the limit of said inclination being at the same predetermined angle for all of said directions, said mounting means additionally including resilient means for urging said rod from said predetermined angle toward said predetermined orientation.

25. A knife sharpener, as defined by claim 24, including means for selecting said predetermined angle from a range of between 3 degrees and 35 degrees relative to said predetermined orientation.

26. The knife sharpener of claim 1 or 24 wherein said mounting means permits rotation of said rod about its lengthwise axis, whereby rod wear can be equalized.

27. The knife sharpener of claim 1 or 24 wherein said rod rotates about its lengthwise axis in response to a user drawing a knife to be sharpened across said rod, thereby automatically equalizing rod wear.

* * * * *